299-13 SR
9/15/81 XR 4,289,354

United States Patent [19]
Zakiewicz

[11] 4,289,354
[45] Sep. 15, 1981

[54] BOREHOLE MINING OF SOLID MINERAL RESOURCES

[75] Inventor: Bohdan M. Zakiewicz, Houston, Tex.
[73] Assignee: Edwin G. Higgins, Jr., Houston, Tex.

[21] Appl. No.: 14,703
[22] Filed: Feb. 23, 1979
[51] Int. Cl.³ ..... E21C 43/00
[52] U.S. Cl. ..... 299/4; 299/2; 299/11; 299/13
[58] Field of Search ..... 299/2, 4, 5, 11, 13

[56] References Cited

U.S. PATENT DOCUMENTS

| | | | |
|---|---|---|---|
| 3,819,231 | 6/1974 | Fehlrer | 299/4 |
| 3,937,025 | 2/1976 | Alvarez-Calderon | 299/11 |
| 3,973,628 | 8/1976 | Colgate | 299/5 |
| 4,043,596 | 8/1977 | Ridley | 299/2 |
| 4,102,397 | 7/1978 | Terry | 299/2 |
| 4,120,355 | 10/1978 | Knepper et al. | 299/11 |

*Primary Examiner*—William F. Pate, III
*Attorney, Agent, or Firm*—Browning, Bushman & Zamecki

[57] ABSTRACT

The present invention comprises a method of mining a solid substance, such as coal, minerals, or the like, from an underground deposit in one of a plurality of earth strata. Void areas are created in the deposit so as to generally define an area within the deposit which is to be enclosed. Plugging material is injected into the void areas to form a relatively impervious barrier enclosing the aforementioned area of the deposit and isolating it from the remainder of the earth strata in which it is located. Conversion media, such as solvents or oxidation supporting media, are then injected into the enclosed area to convert the substance therein into flowable form. Finally, the substance as so converted is withdrawn from the enclosed area.

19 Claims, 6 Drawing Figures

BOREHOLE MINING OF SOLID MINERAL RESOURCES

BACKGROUND OF THE INVENTION

1. Field of the Invention

The present invention pertains to subsurface conversion mining of solid substances, such as coal, lignite, minerals, and the like. Such substances are typically deposited in a stratified earth formation wherein the substance in question forms one seam or stratum, or a portion of a stratum. Of the large number of such deposits existing in the earth, only a relatively small percentage are minable by conventional manual or mechanical mining techniques.

There are several reasons for the unminability of the majority of these deposits. One of these is that conventional mining techniques are typically designated either to mine deposits which are relatively close to the earth's surface, or to mine very deep deposits. Thus, such techniques are not suitable for mining deposits located at intermediate depths. Likewise, most excavation-type mining techniques are designated for use in seams of an intermediate thickness, and are not practical for mining of extremely thick or thin seams. Still other deposits are unminable because they are located beneath cities, and conventional mining of these deposits would pose too great a danger to the structural integrity of the buildings, streets, sewers, etc. of these cities. In still other areas, such prior mining techniques are objected to because of the ecological damage which they may produce.

2. Description of the Prior Art

Accordingly, techniques have been developed for subsurface mining of such deposits by chemical conversion techniques (or unit processes) and/or physical conversion techniques (or unit operations). In such processes, conversion media may be injected into the deposit to be mined through a relatively small well which does not require extensive excavation at the earth's surface. The conversion media converts the solid substance to be mined into a flowable form. For example, in chemical processes combustion supporting media may be injected to burn the solid substance and convert it to a gas. In physical processes, the conversion may involve the injection of a liquid medium which either dissolves the solid substance to be mined or breaks it up forming a slurry or suspension. In any event, the subsurface conversion of the solid substance into a flowable form permits it to be withdrawn from the subsurface stratum by a relatively small well, which again does not require extensive excavation or clearing of the land at the earth's surface.

Such subsurface conversion mining techniques have offered some improvements over the aforementioned mechanical mining processes in that they are not as limited in terms of the depths or thicknesses of seams in which they may be used. However, the prior art conversion techniques have in turn created their own problems. One of these is that, when the deposit to be mined is extremely compact and/or substantially monolithic in form, problems arise in causing the conversion media to properly permeate the formation.

Another major problem in many prior conversion processes is that the conversion may be virtually uncontrolled, both in terms of the direction in which the conversion proceeds and the extent of the deposit which is so converted. This problem is particularly acute in chemical conversion in the form of burning or oxidation. Where such burning is uncontrolled, either in extent or direction it may not only be wasteful and inefficient, but may also lead to collapse of the overburden. Another factor which may contribute to such collapse is the failure of various prior conversion mining processes to provide for proper support of the overburden, regardless of whether or not the conversion proceeds in an uncontrolled manner.

Still another problem with the prior techniques is that they may permit fluids, which might be comprised of the conversion media and/or the flowable products of the conversion process, to pass into strata of the earth formation other than the one being mined. This in turn can lead to contamination of underground supplies of water or other fluids, and in some cases, dangerous gases may even be permitted to pass directly into the earth's atmosphere via a permeable stratum communicating obliquely with the earth's surface. Conversely, the prior processes also generally fail to prevent foreign gases and/or liquids already present within the earth formation from passing into the area being mined and thereby interfering with the conversion process and/or contaminating the products.

SUMMARY OF THE INVENTION

The present invention provides an improved subsurface conversion mining process wherein underground barriers are formed prior to the conversion and removal of the substance to be mined. These barriers may serve a number of purposes including: isolation of an area to be mined to prevent fluids from flowing into or out of that area other than through the controlled wells being utilized in the mining process; support of the overburden to prevent collapse; control of the extent and direction in which the conversion process takes place as well as of process variables such as temperature and pressure; and facilitation of backfilling of the mined or evacuated area.

More specifically, the method involves creating void areas in a deposit to be mined so as to generally define an area within that deposit which is to be enclosed. Plugging media is introduced into the void areas. This forms a relatively impervious barrier enclosing the aforementioned area of the deposit and isolating it from the remainder of the earth stratum in which it is located. The solid substance within the enclosed area may then be converted into flowable form in any suitable manner known to the art and withdrawn in that flowable form from the enclosed area.

One way of creating the void areas is by emplacing explosive charges in the deposit to generally define the area to be enclosed and detonating the charges. The plugging media may be a flowable substance such as gravel or a semi-liquid which is injected to form the aforementioned barrier but is preferably solid or solidifiable whereby the barrier forms a support structure for the overburden of the stratum being mined. The charges are emplaced in the deposit via suitable wells or small diameter boreholes at laterally spaced loci, and a number of charges may be successively detonated at each of these loci to insure the creation of sufficiently large void areas so that, when these areas are filled with the plugging media, an adequate support structure will be formed.

The enclosed area may be further subdivided into a number of separate working units by emplacing secondary explosive charges within the enclosed area adjacent one another so as to generally define subdividing lines, detonating the secondary charges, and injecting plugging media into the void areas so created to form dividing screens. Each such working unit may be progressively mined and backfilled, proceeding from one end of the working unit to the other. As greater and greater portions of the working unit are evacuated by mining, they may be progressively divided from the unevacuated portions by blocking formations progressively formed across the working unit at spaced locations along its length. As each additional mined portion is thus divided off from the unmined portion of the working unit, it may be backfilled without interfering with the continuation of the conversion process. The backfilling cooperates with the aforementioned support structure formed by the outer enclosing barrier to prevent collapse of the overburden after mining of the area is completed. This prevents ecological damage and also makes the process safe for use underneath cities or other valuable structures.

The subdivision of the enclosed area into a number of smaller working units, and the progressive mining and backfilling of these units as described above, controls both the extent and the direction of the conversion process. Each working unit, or the unmined portion thereof divided from previously mined portions by the aforementioned blocking formations, in effect forms an underground retort for conversion of the substance being mined. Thus, all the conversion variables such as temperature, pressure, etc. may be controlled whereby the resulting flowable substance may be caused to have uniform physical and chemical properties as desired. Control and uniformity of the conversion process are also facilitated by the fact that the detonations which are involved in the formation of the barriers and screens also tend to fragment the solid substance within the individual working units so that the conversion media can properly permeate such substance.

It can be seen that the method described above provides for complete, orderly, and controlled conversion mining without extensive excavation at the earth's surface since the explosive charges, plugging media, conversion media, and backfilling may be emplaced in the deposit via relatively small diameter wells or boreholes, and the converted solid substance in flowable form may be withdrawn from the deposit by similar means. This minimizes the ecological and aesthetic damage at the earth's surface. Ecological damage is further precluded by the aforementioned support structure and backfilling which supports the overburden. Additionally, auxiliary barrier means may be formed as needed in permeable strata disposed above the stratum being mined to prevent dangerous fluids from the conversion process from contaminating other fluid deposits and/or reaching the earth's surface. Such auxiliary barriers may be formed in substantially the same manner as the barrier which encloses the area to be mined, but in general, need not form a complete enclosure but only an impervious screen or wall across an area of potential leakage.

Accordingly, it is a principal object of the present invention to provide an improved subsurface conversion mining process.

Another object of the present invention is to provide for support of the overburden during and subsequent to mining.

Still another object of the present invention is to provide for isolation and control of an area being mined from other areas of the earth's formation.

A further object of the present invention is to prevent surface, subsurface or atmospheric contamination in conversion mining.

Still other objects, features, and advantages of the present invention will be made apparent by the following detailed description of the preferred embodiments, the drawings, and the claims.

DESCRIPTION OF THE PREFERRED EMBODIMENT

Figure 1:
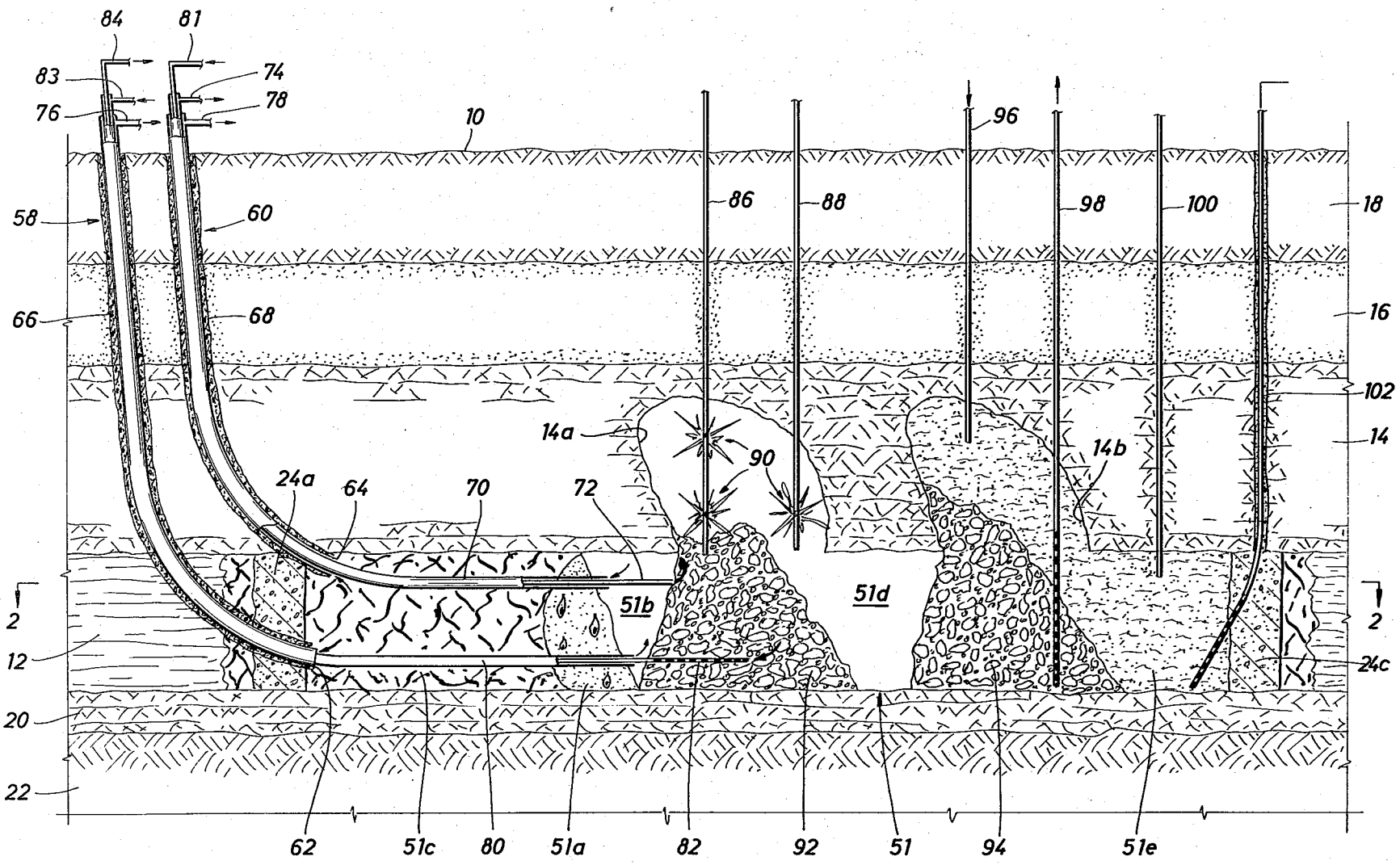
FIG. 1 is a longitudinal cross-sectional view through a stratified earth formation being mined according to the present invention and taken along line 1—1 in FIG. 2.
Figure 2:
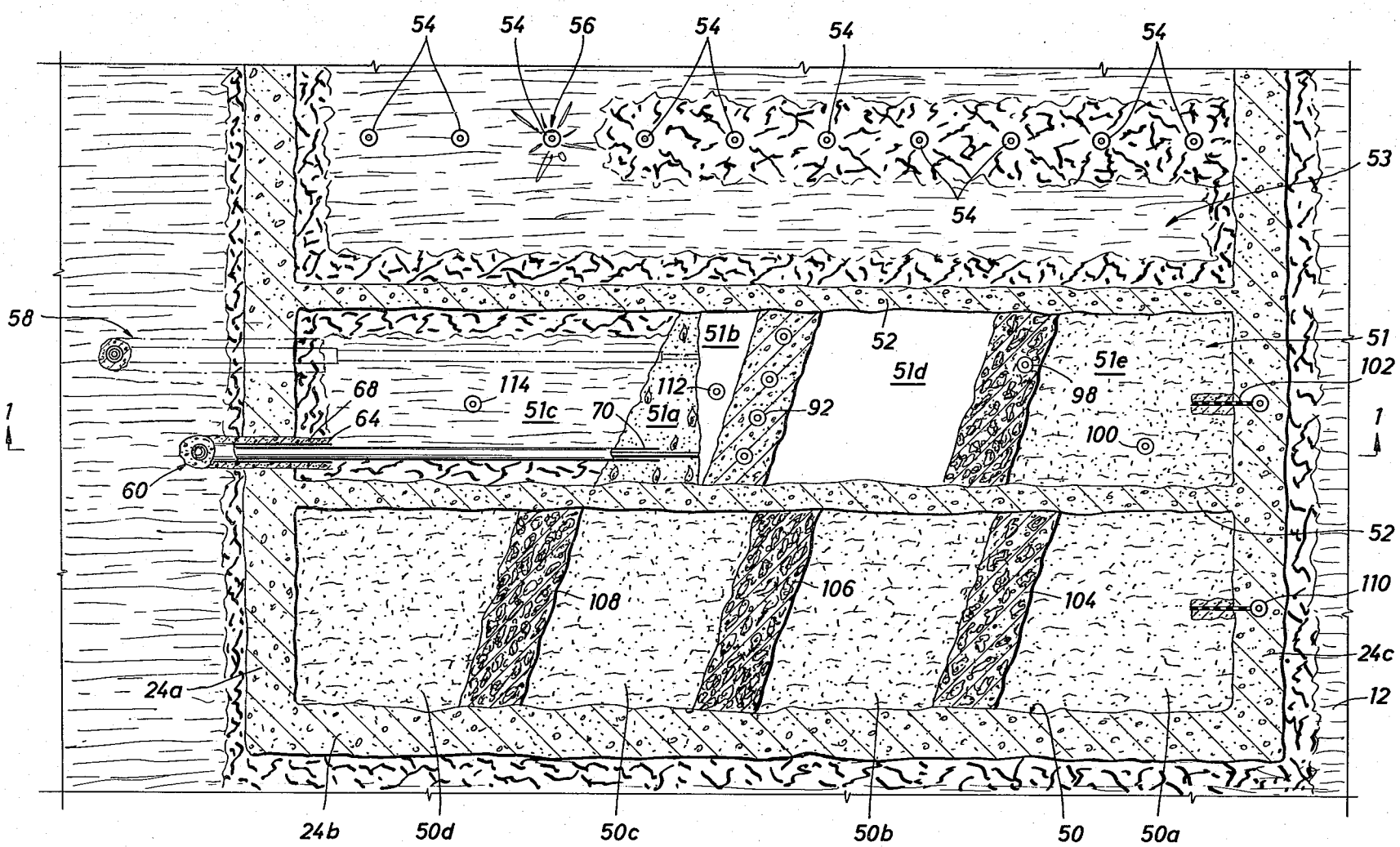
FIG. 2 is a transverse cross-sectional view taken along the line 2—2 in FIG 1.

Referring first to FIGS. 1 and 2, there is shown a typical application of the method of the present invention in a stratified earth formation in which the strata are disposed generally horizontally, i.e. parallel to the earth's surface 10. The exemplary embodiments will be described in connection with the mining of coal by gasification techniques. However, the present invention can be adapted to the mining of various other types of solid materials, such as sulfur, minerals, etc. and can employ numerous conversion processes other than gasification. In this regard, it is noted that the term "conversion" is used herein in a very broad sense to denote any process by which a substantially solid substance is converted into a flowable form, i.e. a form in which it may be transmitted from one location to another through a conduit or the like. The term "flowable substance" is intended to cover gases and liquids as well as slurries or other types of suspensions.

Referring again to FIG. 1, the stratified earth formation includes one stratum 12 which is at least partially comprised of a coal deposit. The overburden of stratum 12 includes a stratum 14 of impervious or semi-impervious shale or the like immediately overlying the coal bearing stratum 12, a stratum 16 of permeable material such as sandstone overlying the shale 14, and an uppermost stratum 18 immediately adjacent the earth's surface 10. Immediately underlying the coal bearing stratum 12, is another stratum 20 of shale beneath which are further earth strata, one of which is indicated as 22.

To mine the coal in stratum 12, a relatively large area of that stratum is enclosed by a barrier, preferably in the form of a relatively thick wall which not only serves to isolate the area to be mined, but also serves to support the overburden 14, 16, 18 so that the latter will not be caused to collapse by the mining operation. The barrier comprises four wall sections, three of which are shown at 24*a*, 24*b*, and 24*c*, and a fourth one of which would join sections 24*a* and 24*c* to completely enclose a generally rectangular area of coal bearing stratum 12.

Figure 3:
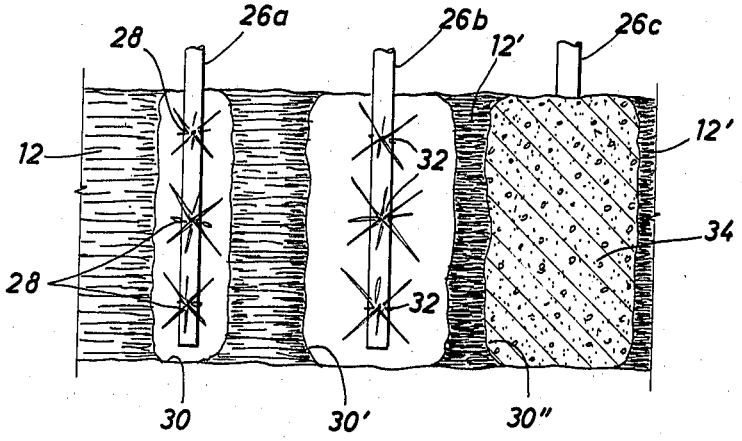
FIG. 3 is a detailed view showing one technique for forming the enclosing and support barrier.

One variation of the technique for forming the enclosing barrier is illustrated in FIG. 3. A plurality of small diameter wells are drilled into the stratum 12 at laterally spaced locations so as to generally outline or define the area to be enclosed. Respective tubular conduits, such as are shown at 26*a*, 26*b*, and 26*c*, are installed in said wells. A plurality of explosive charges is emplaced in each of the conduits. As shown on the far left in FIG. 3, a first set of explosive charges 28 vertically spaced along the portion of conduit 26*a* disposed in stratum 12, is being detonated to form a void area 30 about the locus of the respective casing 26*a*. In the center of FIG. 3, there is shown a subsequent step at the next adjacent well locus 26*b* where a void area such as 30, previously formed by the detonation of a first set of charges, is being further enlarged as indicated at 30′ by the detonation of a second set of explosive charges 32. Additional sets of charges may be successively detonated if needed to enlarge the void area to the desired size. Finally, at the far right in FIG. 3, the fully enlarged void area 30″ formed about the locus of the next adjacent well conduit 26*c*, has been filled with a plugging material 34 injected into void area 30″ via the respective well conduit 26*c*.

The material 34 is shown as a cement. However, any suitable plugging media capable of preventing leakage of liquids or gases into or out of the enclosed area to be mined may be used. Such media is preferably also either solid or solidifiable so that it can also serve to support the overburden. FIG. 3 also shows that the enlarged void areas 30′ and 30″ are not continuous with one another. However, the detonations of the explosive charges fragments and compacts the coal between areas 30′ and 30″ as indicated at 12′ so that it too becomes relatively impervious and cooperates with the interspersed columns of cement to form the aforementioned isolating and support barrier. In a variation of the technique illustrated in FIG. 3, the detonation of successive charges at the locus of each wellbore may be interspersed with injections of the plugging media 34 so that the plugging media introduced by one such injection may be forced outwardly into the coal 12 by the next detonation. This technique may strengthen the resulting barrier while also increasing its imperviousness.

Figure 4:
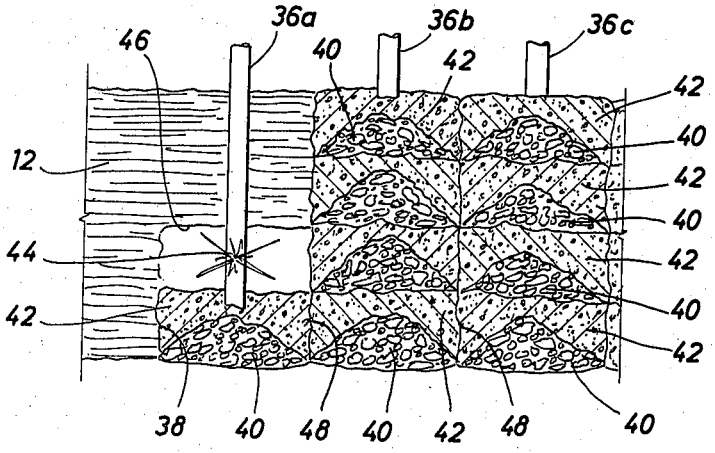
FIG. 4 is a view similar to FIG. 3 showing an alternative technique for forming the enclosing and support barrier.

FIG. 4 shows an alternative technique for forming the isolating and support barrier. As in the technique illustrated in FIG. 3, the variation of FIG. 4 also involves the use of a plurality of well conduits such as 36*a*, 36*b* and 36*c* disposed at laterally spaced apart loci. However, the spacing between well conduits 36 is such that the void areas created by the detonation of explosive charges emplaced in the well conduits will be continuous with one another. At the far left of FIG. 4, there is shown one such void area in the process of being formed about conduit 36*a* and plugged. More specifically, a lowermost portion 38 of this void area has already been formed by detonation of one or more explosive charges emplaced at or near the bottom of well conduit 36*a*. Subsequently, a first plugging media in the form of a solid particulate material such as gravel 40 has been emplaced at the bottom of portion 38 of the void area via well conduit 36*a* in a generally conical formation, as shown, at its natural angle of repose. A second plugging media in the form of a cement 42 was then passed through the corresponding well conduit 36*a* to seal the remainder of portion 38 of the void area. An explosive charge 44 is being detonated to form the next higher portion 46 of the void area about conduit 36*a*. This portion 46 will be plugged with a lower conical formation of gravel and an upper layer of cement in the same manner as lowermost portion 38. Subsequently, higher and higher portions of the void area will be created by detonation of explosive charges and will be similarly plugged. Two such areas 48 about the next two adjacent well conduits 36*b* and 36*c* are shown as having been completely formed and plugged with alternating layers of gravel 40 and cement 42.

The barrier forming techniques illustrated by FIGS. 3 and 4 represent only two of many alternatives. Still other techniques might involve various combinations of one or more of the features of these two alternatives. For example, one such additional alternative could involve the formation of discontinuous or separated void areas such as 30′ and 30″ in FIG. 3 about the loci of the laterally spaced well conduits, with these areas being filled with alternating layers of gravel and cement such as those illustrated in FIG. 4. On the other hand, and as illustrated by the barrier 24*a*, 24*b*, 24*c* in FIGS. 1 and 2, the void areas about the well conduits could be formed so as to be continuous with one another, as in FIG. 4, but could be plugged completely with a single plugging media such as cement. Still other variations are possible. For example, in some cases, gravel alone might be used as the single plugging media. In general, the specific technique to be used in forming the enclosing and support barrier, including the type or types of plugging media used, may be varied to suit the needs of the particular earth formation and mining process, it only being necessary that the barrier be capable of preventing substantial leakage of fluid into or out of the enclosed area, and that it provide adequate support for the overburden of the stratum being mined.

Referring again to FIGS. 1 and 2, the area of the coal bearing stratum 12 enclosed by the barrier 24*a*, 24*b*, 24*c* is further subdivided into a number of elongate generally parallel working units each running from barrier section 24*c* to barrier section 24*a*. Two such working units are shown at 50 and 51 in FIG. 2. The units 50 and 51 are divided from one another by screens 52. At the upper portion of FIG. 2, there is shown still another screen in the process of being formed to divide off a third working unit 53.

Screens 52 ae formed in somewhat the same manner as barriers 24*a*, 24*b*, and 24*c*. As indicated at the upper portion of FIG. 2, a series of well bores have been drilled and lined with conduits 54 at laterally spaced locations to generally define a line extending from barrier portion 24*c* to barrier portion 24*a* generally parallel to the next adjacent screen 52. Explosive charges are emplaced in well conduit 54 and detonated to fragment the surrounding coal and form void areas about the well conduits 54.

Conduits 54 are placed closer together than the conduits used to form the barrier sections 24*a*, 24*b*, and 24*c*. Thus, it is possible to cause the void areas about adjacent ones of the wells 54 to be continuous with one another even though only a single explosive charge, or set of vertically spaced charges, is detonated in each well conduit. However, for the same reasons, i.e. the fact that only a single such charge or series of charges is detonated in each well conduit, such void areas will not be enlarged to the same extent as the void areas created in forming the enclosing and support barriers. Thus, the continuous void areas will typically comprise a relatively narrow network of interconnecting cracks in the fragmented coal. In FIG. 2, wells 54 about which the coal has been fragmented by explosive charges are shown at the right hand side, a charge being detonated is shown at 56, and two wells in which the charges have not yet been detonated are shown at the left.

After such detonations, a plugging media is introduced via well conduits 54 to fill the void areas created by the detonations and form a screen such as those illustrated at 52. Because the screens 52 serve only to separate the various working units 50 and prevent the flow of fluids therebetween, they need not be as thick as the barrier sections 24*a*, 24*b*, and 24*c*, which also serve to support the overburden. For this reason, it is also possible to use different types of plugging media in the screens 52 from that which is used in the support barriers. As shown, the screens 52 are comprised of a cement substantially similar to that used in barrier sections 24*a*, 24*b*, and 24*c*. However, other substantially impervious materials, such as clay or claylike materials, could also be used.

After an individual working unit has been divided off from the remainder of the area enclosed within barrier 24*a*, 24*b*, and 24*c*, the coal therein is progressively converted from one end of the working unit to the other, and the working unit so evacuated is progressively backfilled so as to support the overburden. FIGS. 1 and 2 show one of the working units 51 in the process of being mined and backfilled. Two wells, generally indicated at 58 and 60, are drilled into the working unit 51 so that their lower portions are both vertically and horizontally spaced. Each of the wells 58 and 60 includes three concentric well conduits. The outer conduits 62 and 64 of wells 58 and 60 respectively have their lower ends disposed just inside the working unit 51 near barrier section 24*a* and are cemented to the surrounding earth formation about substantially their entire lengths as indicated at 66 and 68.

Well 60, whose lower portion is disposed above that of well 58 in the area being mined, is the primary conversion or production well. In addition to its outer conduit 64, well 60 includes an intermediate conduit 70 and an innermost conduit 72. Conduit 70 extends inwardly into the area being mined from the lower end of conduit 64 and serves as an outlet conduit for conveying the gases formed by the conversion process to the earth's surface. Conduit 72 extends inwardly into the enclosed mining area a slight distance beyond the end of conduit 70. Conduit 72 serves as the primary inlet conduit for receiving reagents and/or other conversion media used in the conversion process from an inlet line 8' and injecting them into the coal deposit. Near the open ends of conduits 70 and 72 in working unit 51, there is a zone 51*a* of coal in the process of being oxidized and gasified by the conversion media introduced via conduit 72. Immediately to the right of zone 51*a*, there is a zone 51*b* where the coal has been completely converted and which is rich in the resulting gases. Gases from zones 51*a* and 51*b* enter the open end of conduit 70 and are carried via conduit 70 to the earth's surface where they are directed into an outlet line 74 communicating with conduit 70, whereby they may be transported for processing or storage.

Intermediate the zone 51*a* and barrier section 24*a*, there is a zone 51*c* of coal which has not yet been converted, but which has been at least partially fragmented by the explosive charges used in forming the adjacent barrier section 24*a* and screens 52. Not all of the gases produced by the conversion process are collected by conduit 70, and the aforementioned fragmenting of the unmined coal zone 51*c* enhances the ability of such uncollected gases to leak toward barrier section 24*a*. Since barrier 24*a*, screens 52, and strata 14 and 20 are all impervious, gases leaking toward barrier 24*a* in this manner can only escape via conduits 62 and 64 whereby they are carried to the earth's surface and into respective connecting outlet lines 76 and 78.

Well 58, in addition to outer conduit 62, also includes an intermediate conduit 80 which extends beyond the lower end of conduit 62 into the area being mined approximately to the same extent as conduit 70 of well 60. Well conduit 80 has its upper end connected to an inlet line 83 and serves as an auxiliary inlet conduit for injecting additional reagents or other conversion media for the gasification process. Well 58 also includes an innermost conduit 82 extending beyond the end of conduit 80 and also beyond the end of conduit 72 thereabove. The portion of conduit 82 so extending is perforated as shown and serves as an inlet for collecting liquids from the lower portion of the working unit being mined. Such liquids may be by-products of the conversion process and/or excess liquids from the backfilling process (to be described more fully hereinafter). These liquids are carried to the earth's surface via conduit 82, by force of a suitable pump (not shown) and into a discharge line 84 communicating with conduit 82. As the coal adjacent the ends of conduits 70, 72, and 80 is gasified, and the surrounding area substantially evacuated, conduits 70, 72, 80, and 82 may be progressively withdrawn into the respective outer well conduits 64 and 62, i.e. toward barrier section 24*a*, to progressively convert the remainder of the coal in working unit 51.

To the right of zone 51*b*, there is a zone 51*d* of the working unit which has been substantially evacuated by the conversion process. Two wells have been drilled into the stratum 14 generally above zone 51*d* and provided with respective well conduits 86 and 88. Explosive charges 90 have been emplaced in the conduits 86 and 88 and detonated as shown to explosively collapse a portion of shale stratum 14 and cause a mass of rubble to fall into zone 51*d* forming a blocking formation 92 extending across working unit 51 to divide zone 51*d* from zones 51*a*, 51*b*, and 51*c*. This permits zone 51*d* to be backfilled without interfering with the conversion process being performed on the other side of blocking formation 92.

When zone 51*d* was being mined, another blocking formation 94 was formed in the same manner to divide zone 51*d* from a previously evacuated zone 51*e*. FIGS. 1 and 2 show zone 51*e* in the process of being backfilled. Wells having respective conduits 96, 98 and 100 extend into zone 51*e*. The wells in which conduits 96 and 98 are located may be the same wells which were used to explosively collapse a portion of stratum 14 to form the blocking formation 94. Wells 96 and 100 are injection wells by which a sand slurry or other suitable backfilling media is injected into zone 51*e*. Zone 51*e* is continuous with the portion 14*b* of stratum 14 evacuated by the explosive charges forming blocking formation 94. Thus, the slurry introduced into zone 51*e* through conduits 96 and 100 will also fill the evacuated area 14*b*. Well conduit 98 is a drainage conduit having a perforated lower end which extends into the lower area of zone 51*e*, and more specifically, into the blocking formation 94. As the sand in the slurry being injected through wells 96 and 100 gradually settles, the water is withdrawn through conduit 98 by means of a pump (not shown) to leave a substantially sandy backfilling to support the overburden. An observation well has its conduit 102 extending into zone 51*e* and cemented to the strata 14, 16, and 18 thereabove for producing electrical signals indicative of the condition of zone 51*e*.

Zone 51*d* will be backfilled in substantially the same manner as zone 51*e*. Subsequently, as additional portions of working unit 51 are evacuated, they will be similarly progressively divided off from the unmined portion and backfilled in like manner. In FIG. 2 there is shown a working unit 50 which has been completely mined and backfilled, having been progressively subdivided into zones 50*a*, 50*b*, 50*c* and 50*d* by blocking formations 104, 106, and 108. Additional observation wells may be provided as needed, e.g., as indicated at 110, 112, and 114 in FIG. 2. It will be understood that subsequent working units, such as the one being formed at 53 in FIG. 2, will be progressively mined and backfilled in substantially the same manner as described hereinabove.

Figure 5:
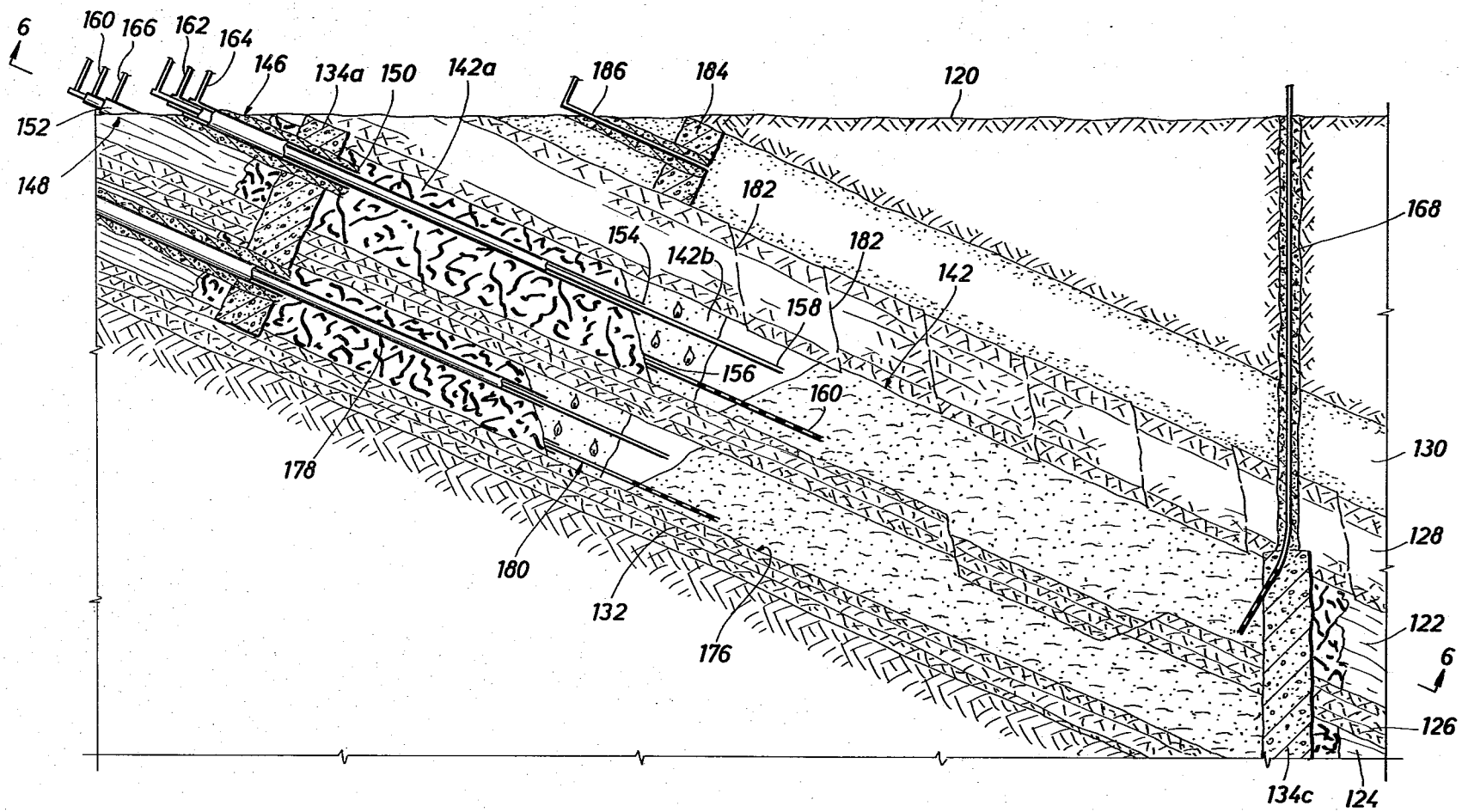
FIG. 5 is a longitudinal sectional view through a different type of earth formation being mined according to the present invention and taken along the line 5—5 in FIG. 6.
Figure 6:
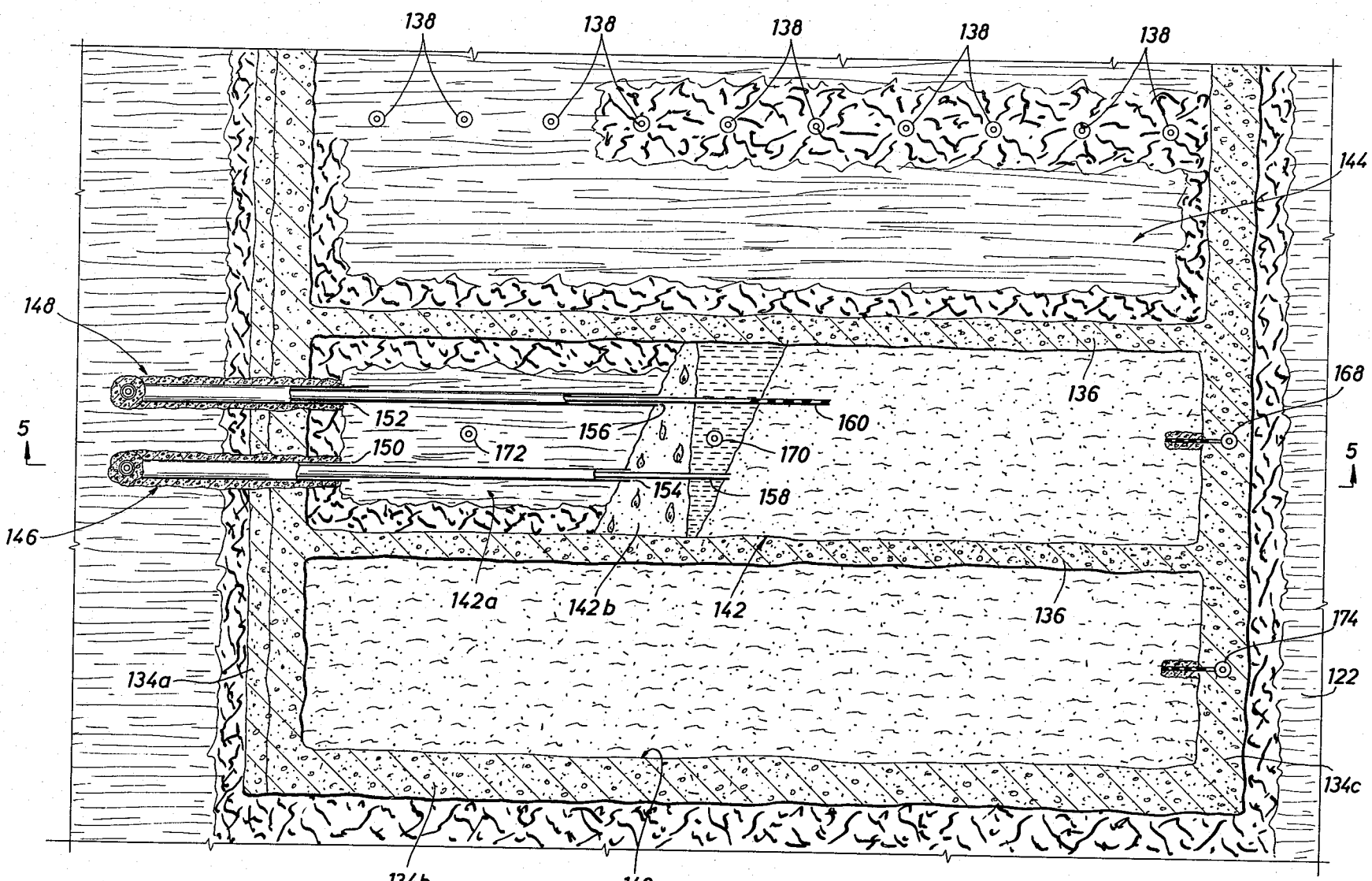
FIG. 6 is a transverse cross-sectional view taken on line 6—6 of FIG. 5.

Referring now to FIGS. 5 and 6, there is shown another version of the process of the present invention adapted for a different type of formation, i.e., one in which the strata are disposed at an angle to the earth's surface 120. In particular, the formation shown in FIG. 5 includes two strata, 122 and 124, each comprising a coal seam or deposit and divided from each other by an intermediate stratum 126 of shale. Overlying the uppermost coal bearing stratum 122 is another stratum 128 of shale and a stratum 130 of a permeable substance such as sandstone. Underlying the lower coal bearing stratum 124 is a stratum 132 of shale. Because the strata 122, 124, 126, 128, 130, and 132 are disposed at an oblique angle to horizontal, each extends upwardly substantially to the earth's surface 120.

Since the coal bearing strata 122 and 124 lie closely adjacent each other, areas to be mined within both of said strata may be conveniently enclosed by a common barrier extending through each of the coal bearing strata 122 and 124 as well as through the intermediate stratum 126 of shale. This barrier includes sections 134*a*, 134*b*, and 134*c* as shown, as well as a fourth section, not shown, generally parallel to section 134*b* and interconnecting 134*a* and 134*c*. Section 134*c* extends across the lower ends of the enclosed areas of strata 122, and 124, and due to the depth of said lower ends, is most conveniently formed in a substantially vertical orientation as shown. However, barrier section 134*a*, at the upper end of the enclosed areas, may be formed substantially perpendicular to the strata themselves as shown. Section 134*b*, as well as the fourth section that is not shown in the drawing, extend angularly through the earth formation to interconnect sections 134*a* and 134*c*.

Otherwise, the barrier in the embodiment of FIGS. 5 and 6 is substantially identical to the barrier of the embodiment as shown in FIGS. 1 and 2, and may be formed in substantially the same manner or using any of the alternative techniques suggested by FIGS. 3 and 4. Like the barrier of FIGS. 1 and 2, the barrier of FIGS. 5 and 6 serves not only to prevent fluid leakage into or out of the enclosed areas, but also to support the overburden. The respective areas in strata 122 and 124 enclosed by the aforementioned barrier are further subdivided into working units by screens such as 136 in FIG. 6. Like the barrier sections 134*a*, 134*b* and 134*c*, screens 136 may be common to the two coal bearing strata, or they may be separate. Screens 136 are formed in substantially the same manner as screens 52 in the first embodiment. At the upper portion of FIG. 6, there are shown a plurality of well conduits 138 in which explosive charges are being progressively detonated to form void areas which will be filled with a plugging media to form a third screen.

The coal within the enclosed areas of strata 122 and 124 may be mined by a conversion process either simultaneously or successively. As shown, the two overlying areas are being mined simultaneously. More specifically, in the enclosed area of stratum 122, one working unit 140 has previously been mined and backfilled. The next adjacent working unit 142 is in process of being mined and backfilled, while as mentioned above, the next adjacent working unit 144 is in the process of being divided off by a screen. Two wells, 146 and 148, have been drilled into working unit 142 through upper end barrier section 134*a*. Wells 146 and 148 include respective outer conduits 150 and 152, each being cemented to the surrounding formation and having an open lower end disposed just inside barrier section 134*a*. Wells 146 and 148 further include respective intermediate conduits 154 and 156 each extending into the enclosed area beyond the lower end of the respective outer well conduit 150 or 152. Finally, the wells include respective inner conduits 158 and 160 extending beyond the lower ends of respective intermediate conduits 154 and 156.

The intermediate conduit 156 of well 148 has its upper end communicating with an incoming line 160 and serves as an inlet conduit for injecting the reagents or other conversion media. The intermediate conduit 154 of well 146 serves as the primary outlet conduit for removing the gas products of the conversion process, its upper end being communicated with an outlet line 162. Conduits 150 and 152 serve to remove gases which leak through the unmined zone 142*a* of working unit 142, the upper end of conduits 150 and 152, being connected to respective outlet lines 164 and 166. As shown, zone 142*b* of working unit 142, located adjacent the end of conduits 154 and 156, is in the process of being gasified. In the form of the invention illustrated in FIGS. 5 and 6, the working units are mined beginning at the lowermost end thereof, and the conduits 154, 156, 158 and 160 are progressively withdrawn upwardly to convert higher and higher zones of the working unit as the lower zones are evacuated. Because the strata are disposed at an angle to horizontal, and because the conversion process progresses upwardly, it is not necessary to further subdivide the working unit for progressive backfilling. Instead, the appropriate backfilling material is simply introduced via the innermost conduit 158 of well 146. This backfilling media is in the form of a sand slurry which naturally flows downwardly into the evacuated portion of the working unit 142 so that it cannot interfere with the conversion process being carried on thereabove. As the sand settles, the water from the slurry is withdrawn via conduit 160, the lower end of which is perforated and extends downwardly beyond the end of conduit 158. As mentioned, conduits 158 and 160 may be gradually drawn upwardly as the process progresses so as to backfill higher and higher areas of the working unit 142. Observation well conduits are provided as needed, e.g. at 168, 170, 172, and 174.

An underlying working unit 176 of the enclosed area of the lower coal bearing stratum 124 is being mined in a similar manner as shown in FIG. 5. More specifically, working unit 176 is provided with a well 178 which corresponds in both structure and function with well 146, and also with a well 180 which corresponds to well 148.

As shown in FIG. 5, the shale stratum 128 overlying the upper coal bearing stratum 122, while generally impervious, has a number of faults 182 through which gases from the conversion process may leak into the permeable sandstond stratum 130. Then, because stratum 130 extends angularly to the earth's surface, dangerous gases could escape. To prevent this, a barrier 184 is formed transversely across the upper portion of stratum 130 near its upper end. Barrier 184 may be formed by any of the techniques described hereinabove for forming the enclosing barriers and/or screens in the coal bearing strata. Thus barrier 184 will block the flow of gas through stratum 130 to the earth's surface. Furthermore, by providing a well conduit 186 extending downwardly through barrier 184 and cemented to the surrounding formation, these gases may be recovered in a controlled manner.

It can be seen that both of the embodiments of the present invention described hereinabove achieve a number of advantageous results. The enclosing barriers not only support the overburden of the coal strata being mined, but also provide for gross control of the operation by preventing leakage of the process fluids from the mining area and/or ingress of water or other underground fluids into the mining area. The further subdivision of each enclosed area by the screens, and (where necessary) blocking formations, provides for further fine control of the conversion process, not only in terms of the extent of coal formation which is being gasified at any given time, but also in terms of the direction in which the conversion process progresses. Furthermore, these subdivisions permit each working unit to, in effect, form a closed underground retort whereby the various physical and chemical variables of the conversion process may be precisely controlled. The process also permits the working unit to be progressively backfilled to prevent subsequent collapse of the overburden. Finally, clearing of the land at the earth's surface and excavation thereof is minimized, and in particular, it is limited to the drilling of a number of wells, the upper ends of which represent only a very small area compared to the area actually being evacuated below the surface of the earth. This, of course, minimizes ecological and aesthetic damage attendant upon the mining operation. By the same token, this latter procedure also makes the process of the present invention adaptable for the mining of deposits located beneath cities or other valuable structures.

In another variation of the invention, the void areas into which the plugging media is introduced may be formed by means other than subsurface explosions. For example, where the deposit is not particularly deep, the void areas may be formed by trenching, and suitable plugging media may be introduced into the trenches to form an imprevious enclosing barrier. Such a barrier may serve many of the same purposes as the barriers of the embodiments described above including: preventing egress of reagents, etc. from the enclosed area other than through controlled wells or the like, preventing ingress of other subsurface fluids into the enclosed area, and facilitating backfilling operations.

It will be noted that numerous other modifications of the examplary embodiments described hereinabove may be made by those with skill in the art. For example, in the embodiments shown, the various working units within an enclosed area have been shown as being divided off, mined and backfilled one after another. However, it is also possible to completely form the enclosing and support barrier as well as the screens which divide the working units from one another before beginning any mining or backfilling operations. Likewise, the number, type, and location of the well conduits may vary depending on the particular formation being mined and the type of conversion process being used. Other modifications have been suggested above, and still others will occur to those with skill in the art. Accordingly, it is intended that the scope of the present invention be limited only by the claims which follow. More specifically, the mere recital of process steps in a given order is not intended to limit a claim to performance of the steps in that order unless the claim language or the nature of the steps dictate otherwise.

I claim:

1. A method of mining a solid substance in an underground deposit in one of a plurality of earth strata comprising the steps of:

creating void area in said one earth stratum by emplacing a plurality of explosive charges adjacent one another in said one earth stratum in a plurality of laterally spaced apart loci so as to generally define an area within said deposit to be enclosed, and detonating said charges to create said void areas, said void areas so formed being substantially continuous with one another;

introducing plugging media into said void areas to form a relatively impervious barrier enclosing said area of said deposit and isolating it from the remainder of said one earth stratum;

converting said solid substance within said enclosed area into flowable form by injecting conversion media into said enclosed area;

and withdrawing said converted substance from said area.

2. The method of claim 1 wherein said plugging media comprises a solid or solidifiable material whereby said barrier forms a support structure for the overburden of said one earth stratum.

3. The method of claim 2 wherein a plurality of such charges are successively detonated in each of said loci to form and progressively enlarge a generally void area about each of said loci.

4. The method of claim 3 wherein said plugging media comprises a solid particulate material and a semi-liquid solidifiable material injected into each of said void areas in alternating layers.

5. The method of claim 4 wherein said particulate material is gravel, and said semi-liquid is a cement.

6. The method of claim 2 further comprising:

emplacing secondary explosive charges within said enclosed area adjacent one another so as to generally define lines subdividing said area;

detonating said secondary charges:

injecting plugging media into void areas created by the detonation of said secondary charges to form relatively impervious screen means subdividing said area into a plurality of working units.

7. The method of claim 1 further comprising forming auxiliary barrier means in a permeable earth stratum disposed adjacent said one earth stratum.

8. The method of claim 1 further comprising backfilling said enclosed area as evacuated by the withdrawal of said converted substance.

9. A method of mining a solid substance in an underground deposit in one of a plurality of earth strata comprising the steps of:

creating void areas in said one earth stratum by emplacing a plurality of explosive charges adjacent one another in said one earth stratum so as to generally define an area within said deposit to be enclosed, and detonating said charges to create said void areas;

introducing plugging media into said void areas to form a relatively impervious barrier enclosing said area of said deposit and isolating it from the remainder of said one earth stratum, said plugging media comprising a solid or solidifiable material whereby said barrier forms a support structure for the overburden of said one earth stratum;

emplacing secondary explosive charges within said enclosed area adjacent one another so as to generally define lines subdividing said area;

detonating said secondary charges;

injecting plugging media into void areas created by the detonation of said secondary charges to form relatively impervious screens subdividing said area into a plurality of working units;

converting said solid substance within said working units into flowable form by injecting conversion media into said working units;

and withdrawing said converted substance from said working units.

10. The method of claim 9 wherein said working units are arranged in generally parallel rows and said solid substance is converted and withdrawn from each working unit progressively from one end thereof to the other end.

11. The method of claim 10 further comprising progressively backfilling said working unit as said converted substance is withdrawn therefrom.

12. The method of claim 11 comprising further subdividing each of said working units by a plurality of blocking formations spaced along the length of said working unit and each extending transversely across said working unit.

13. The method of claim 12 wherein said blocking formations are progressively formed along the length of said working units, each of said blocking formations being formed to divide a substantially evacuated portion of said working unit from which said converted substance has been withdrawn from an un-evacuated portion; the evacuated portions being successively backfilled as they are divided from the unevacuated portions.

14. The method of claim 13 wherein each of said blocking formations is formed by explosively collapsing a portion of a second earth stratum overlying said one earth stratum, but underlying the uppermost stratum, to cause a mass of rubble from said second earth stratum to fall into said evacuated portion.

15. The method of claim 14 further comprising backfilling the spaces in said second earth stratum created by said explosive collapsing.

16. The method of claim 15 wherein each of said spaces in said second earth stratum is continuous with the evacuated portion of said working unit divided from an unevacuated portion by the respective one of said blocking formations.

17. The method of claim 11 wherein said explosive charges, plugging media, conversion media, and backfilling are emplaced in said one earth stratum, and said converted substance in flowable form is withdrawn from said one earth stratum, via relatively small diameter wells without substantial excavation of the uppermost earth stratum.

18. The method of claim 16 wherein said strata are disposed obliquely to the earth's surface.

19. A method of mining a solid substance in an underground deposit in one of a plurality of earth strata comprising the steps of:

creating void areas in said one earth stratum by emplacing a plurality of explosive charges adjacent one another in said one earth stratum in a plurality of laterally spaced apart loci so as to generally define an area within said deposit to be enclosed, and detonating said charges to create said void areas about said loci, said void areas so formed being discontinuous and interspersed with columns of said one earth stratum fragmented and compacted between said loci by said detonations;

introducing plugging media into said void areas to form, together with said columns of fragmented and compacted material of said one earth stratum, a relatively impervious barrier enclosing said area of said deposit and isolating it from the remainder of said one earth stratum;

converting said solid substance within said enclosed area into flowable form by injecting conversion media into said enclosed area;

and withdrawing said converted substance from said area.

* * * * *

UNITED STATES PATENT AND TRADEMARK OFFICE

CERTIFICATE OF CORRECTION

PATENT NO. : 4,289,354

DATED : September 15, 1981

INVENTOR(S) : Bohdan M. Zakiewicz

It is certified that error appears in the above—identified patent and that said Letters Patent is hereby corrected as shown below:

In Column 12, line 22, delete "area" and insert therefor --areas--.

In Column 12, line 58, delete "charges:" and insert therefor --charges;--.

Signed and Sealed this

*Twelfth* Day of *February 1985*

[SEAL]

*Attest:*

DONALD J. QUIGG

*Attesting Officer* *Acting Commissioner of Patents and Trademarks*